US009010058B2

(12) United States Patent
DeJarnette et al.

(10) Patent No.: US 9,010,058 B2
(45) Date of Patent: Apr. 21, 2015

(54) SHINGLE WITH TRANSITION DEVICE FOR IMPACT RESISTANCE

(71) Applicant: Building Materials Investment Corporation, Wilmington, DE (US)

(72) Inventors: Daniel C. DeJarnette, Fairhope, AL (US); William B. Corley, Sr., Wilmer, AL (US); Willie R. Grice, Saraland, AL (US); Skyler G. Hare, Spanish Fort, AL (US); Mark T. Glover, Fairhope, AL (US); Billy R. Brown, Mobile, AL (US); Sean C. Marren, Alta Loma, CA (US); Olan T. Leitch, Bakerfield, CA (US); Keith E. Stephens, Waxahachie, TX (US)

(73) Assignee: Building Materials Investment Corporation, Wilmington, DE (US)

( * ) Notice: Subject to any disclaimer, the term of this patent is extended or adjusted under 35 U.S.C. 154(b) by 0 days.

(21) Appl. No.: 13/968,056

(22) Filed: Aug. 15, 2013

(65) Prior Publication Data

US 2015/0047285 A1 Feb. 19, 2015

(51) Int. Cl.
*E04D 1/00* (2006.01)
*E04D 1/20* (2006.01)

(52) U.S. Cl.
CPC ..... *E04D 1/20* (2013.01)

(58) Field of Classification Search
CPC ..... E04D 1/26; E04D 1/28; E04D 1/265; E04D 2001/005; E04D 1/20
USPC ..... 52/518, 519, 560, 543, 553
See application file for complete search history.

(56) References Cited

U.S. PATENT DOCUMENTS

| | | | | | |
|---|---|---|---|---|---|
| 3,547,674 | A * | 12/1970 | Gagle et al. | 442/123 |
| 3,900,102 | A * | 8/1975 | Hurst | 206/411 |
| 3,937,640 | A * | 2/1976 | Tajima et al. | 156/71 |
| 4,848,057 | A * | 7/1989 | MacDonald et al. | 52/518 |
| 4,871,605 | A * | 10/1989 | Pagen et al. | 428/141 |
| 5,426,902 | A * | 6/1995 | Stahl et al. | 52/314 |
| 5,453,313 | A * | 9/1995 | Kiser | 428/143 |
| 5,525,399 | A * | 6/1996 | Kiser | 428/141 |
| 5,580,638 | A * | 12/1996 | Kiser | 428/143 |
| 5,582,864 | A * | 12/1996 | Kiser | 427/186 |
| 5,587,234 | A * | 12/1996 | Kiser | 428/327 |
| 5,816,014 | A * | 10/1998 | Tzeng et al. | 52/745.19 |
| 5,822,943 | A * | 10/1998 | Frankoski et al. | 52/518 |
| 6,195,951 | B1 * | 3/2001 | Stahl et al. | 52/314 |
| 6,341,462 | B2 | 1/2002 | Kiik et al. | |
| 6,418,692 | B1 * | 7/2002 | Freshwater et al. | 52/553 |
| 6,519,905 | B1 * | 2/2003 | Knighton | 52/378 |
| 6,530,189 | B2 * | 3/2003 | Freshwater et al. | 52/553 |
| 7,851,051 | B2 | 12/2010 | DeJarnette et al. | |
| 8,752,351 | B2 * | 6/2014 | Belt et al. | 52/558 |
| 2002/0011043 | A1 * | 1/2002 | Freshwater et al. | 52/518 |
| 2005/0204675 | A1 * | 9/2005 | Snyder et al. | 52/555 |
| 2007/0044410 | A1 * | 3/2007 | Kalkanoglu | 52/526 |
| 2009/0100779 | A1 * | 4/2009 | Cluthe | 52/543 |
| 2011/0185668 | A1 * | 8/2011 | Kiik et al. | 52/518 |

* cited by examiner

*Primary Examiner* — Mark Wendell
*Assistant Examiner* — Keith Minter
(74) *Attorney, Agent, or Firm* — Baker Botts L.L.P.

(57) ABSTRACT

An impact resistant shingle is provided which includes an asphalt-coated substrate having a first surface and a second surface, the first surface having a headlap portion and an exposure portion. The headlap portion comprises a transition zone disposed at an edge region of the substrate distal to the exposure portion. The first surface of the substrate exclusive of the transition zone comprises granules, wherein the shingle has a smaller thickness dimension at the transition zone than a thickness dimension of a remaining area of the shingle.

20 Claims, 6 Drawing Sheets

SHINGLE WITH TRANSITION DEVICE FOR IMPACT RESISTANCE

BACKGROUND OF THE DISCLOSED SUBJECT MATTER

1. Field of the Disclosed Subject Matter

The disclosed subject matter relates to roofing material, and in particular to roofing shingles, having a transition zone which imparts improved characteristics, such as impact resistance to damage from hail, ice, and other debris.

2. Description of the Related Art

Roofing material, such as shingles, has a front upper surface, at least a portion of which is intended to be exposed to weather, and a back lower surface facing in the direction opposite to the upper surface. The shingles are installed overlapping such that the headlap of the front upper surface of a shingle is disposed underneath the exposed portion of a shingle thereabove. Traditionally, the back, non-weather-exposed surface of roofing material has been covered with finely ground mineral material ("fines") so that the asphalt backing does not adhere to contiguous roofing material when packaged for transport and storage. Such finely divided materials include mica flakes, copper slag, coal slag, sand, talc and silica dust. The front exposed surface of roofing material can also include the fines in certain applications.

In many areas, the roofing materials on buildings, particularly the shingles on residential dwellings, are damaged by hail, ice, and other debris. The damage is caused by the impact of external forces such as hail stones striking shingles resulting in visible cracking, tearing, snapping or imperceptible damage to the shingles' structure which can render the shingles less resistant to the elements of wind, rain, snow and ice. Frequently, such damage requires the costly replacement of roofing materials to prevent the elements from entering into the building.

There are several solutions in the art which have attempted to improve the impact resistance of shingles. U.S. Pat. No. 6,341,462 B2, to Kiik et al., the subject matter of which is herein incorporated by reference, discloses a roofing material with improved resistance to damage by hail having an energy-absorbing backing layer adhered to its lower surface. The backing layer of U.S. Pat. No. 6,341,462 comprises fiber and binding components with a combined weight ranging between 0.5 and 5 lbs. per square (100 square feet) of shingle material such that the exposed portion of a shingle made according to U.S. Pat. No. 6,341,462 appears more substantial and is, indeed, visibly thicker prior to application than products made without the backing layer. U.S. Pat. No. 7,851,051, to DeJarnette et al., the subject matter of which is herein incorporated by reference, discloses a roofing material with improved resistance to damage by hail having an upper and lower surface in which a thin layer comprising re-melted polypropylene or other suitable plastic is adhered to at least a portion of its lower surface.

As most shingles are installed overlapping with adjacent shingles, the top edge of an underlying shingle ends at an approximate center region of an overlying shingle. This top edge of the underlying shingle can cause further stresses to the overlying shingle when impact forces, such as hail, strike this approximate center region. The edge of the underlying shingle can create a relatively sharp drop off ledge which can impose additional stresses on the overlying shingle. Thus, there remains a continued need for an efficient and economic system for impact resistance for roofing materials, such as shingles. The presently disclosed subject matter satisfies these and other needs.

SUMMARY

The purpose and advantages of the disclosed subject matter will be set forth in and are apparent from the description that follows, as well as will be learned by practice of the disclosed subject matter. Additional advantages of the disclosed subject matter will be realized and attained by the devices particularly pointed out in the written description and claims hereof, as well as from the appended drawings.

To achieve these and other advantages and in accordance with the purpose of the disclosed subject matter, as embodied and broadly described, the disclosed subject matter includes an impact resistant shingle, comprising: an asphalt-coated substrate having a first surface and a second surface, the first surface having a headlap portion and an exposure portion. The headlap portion comprises a transition zone disposed at an edge region of the substrate distal to the exposure portion. The first surface of the substrate exclusive of the transition zone comprises granules, wherein the shingle has a smaller thickness dimension at the transition zone than a thickness dimension of a remaining area of the shingle.

In accordance with another aspect of the disclosed subject matter, an impact resistant shingle is provided, comprising: a substrate comprising an asphalt coating modified with styrene-butadiene-styrene (SBS) polymer. The substrate has a first surface and a second surface, the first surface having a headlap portion and an exposure portion. The headlap portion comprises a transition zone disposed at an edge region of the substrate distal to the exposure portion, wherein the first surface of the substrate exclusive of the transition zone comprises granules. The shingle has a smaller thickness dimension at the transition zone than a thickness dimension of a remaining area of the shingle. The shingle further includes an impact layer coupled to the second surface opposite the exposure portion, wherein the impact layer reinforces the shingle and absorbs an impact force from an external environment. A transition layer is coupled to the headlap portion at the transition zone and has a width extending a width of the transition zone, wherein the transition zone maintains a smaller thickness dimension of the shingle at the transition zone.

In accordance with another aspect of the disclosed subject matter, a roofing system of impact resistance shingles is provided comprising: a first shingle having any of the characteristics as disclosed herein and a second shingle having any of the characteristics as disclosed herein. The headlap portion of the first shingle is disposed underneath the exposure portion of the second shingle, and wherein the transition zone of the first shingle reduces effects of the impact force on the second shingle when an impact force from the external environment strikes the second shingle.

It is to be understood that both the foregoing general description and the following detailed description and drawings are examples and are provided for purpose of illustration and not intended to limit the scope of the disclosed subject matter in any manner.

The accompanying drawings, which are incorporated in and constitute part of this specification, are included to illustrate and provide a further understanding of the devices of the disclosed subject matter. Together with the description, the drawings serve to explain the principles of the disclosed subject matter.

BRIEF DESCRIPTION OF THE DRAWINGS

The subject matter of the application will be more readily understood from the following detailed description when read in conjunction with the accompanying drawings, in which.

DETAILED DESCRIPTION

Reference will now be made in detail to embodiments of the disclosed subject matter, an example of which is illustrated in the accompanying drawings. The disclosed subject matter will be described in conjunction with the detailed description of the system.

In accordance with the disclosed subject matter, an impact resistant shingle is provided which includes an asphalt-coated substrate having a first surface and a second surface, the first surface having a headlap portion and an exposure portion. The headlap portion comprises a transition zone disposed at an edge region of the substrate distal to the exposure portion. The first surface of the substrate exclusive of the transition zone comprises granules, wherein the shingle has a smaller thickness dimension at the transition zone than a thickness dimension of a remaining area of the shingle.

Figure 1:
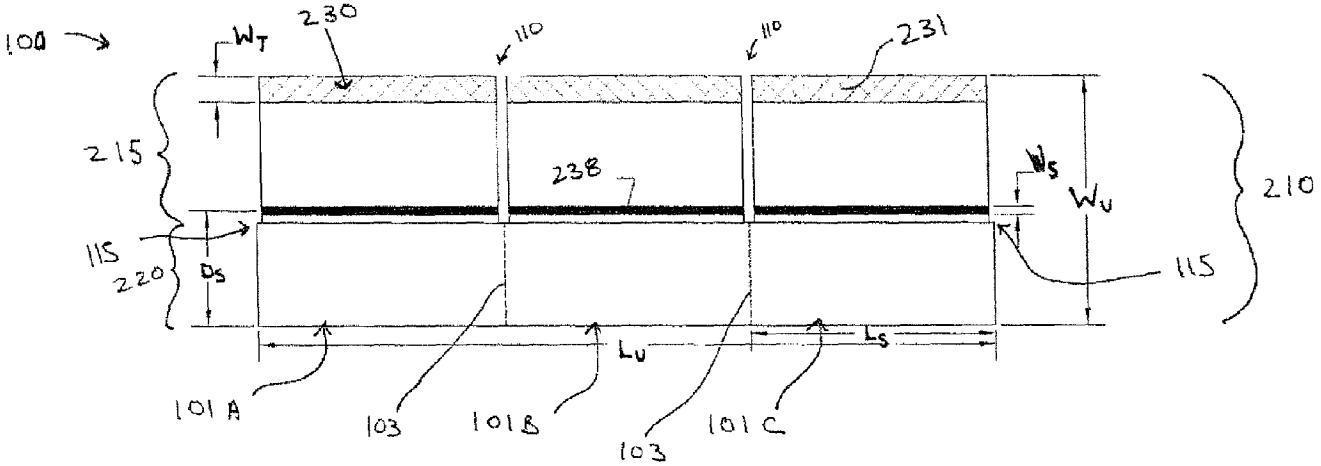
FIG. 1 depicts the exposure side of a shingle unit of hip and ridge shingles, according to an embodiment of the disclosed subject matter.

Although not so limited in its application, the presently disclosed subject matter may be applied to what are known in the industry as hip and ridge shingles which are used on angular contours of a roof such as the peaks. Solely for purpose of illustration, an exemplary embodiment of a shingle, is shown schematically in FIG. 1. The examples herein are not intended to limit the scope of the disclosed subject matter in any manner. Particularly, and as illustrated, FIG. 1 depicts an impact resistant shingle unit 100. In the embodiment of FIG. 1, the shingle unit includes three adjoining hip and ridge shingles 101A, 101B, and 101C. The three shingles 101A-101C are adjoined along lines 103 which can be perforated or separable as desired, prior to installation. The three shingles 101A-101C can be substantially similar to each other in aesthetics and structure.

The shingle unit can be any suitable shape, size, and dimension. The shingle unit 100 of FIG. 1 and each shingle 101A-C comprise a substantially rectangular shape although other shapes such as, but not limited to, square, oblong, trapezoidal, chamfered, and the like are contemplated herein. The shingle unit 100 has a predetermined length $L_U$ and width $W_U$. The length $L_U$ can range from approximately 30 to approximately 60 inches and the width $W_U$ can range from approximately 10 to approximately 20 inches, depending on the desired use. In the embodiment of FIG. 1, the length $L_U$ comprises approximately 36 inches and the width $W_U$ comprises approximately 12 inches. Depending on the number of shingles comprising each shingle unit, each shingle can have a length $L_S$ determined by the length $L_U$ divided by the number of shingles. In the embodiment of FIG. 1, each shingle 101A-C has length $L_S$ of approximately 12 inches.

The shingle unit 100 can further include recesses 110 which can further define each hip and ridge shingle 101A-101C. The shingle unit can further include lip portions 115 near an approximate center of the shingle unit 110. The lip portions 115 can provide further cover and protection for roofs and further allow for overlap of shingles horizontally. As shown with respect to the lip portions 115, each shingle 101A-C can have different proportions of the headlap portion 215 and the exposure portion 220. As shown, the width of the headlap portion 215 is narrower than the exposure portion 220. This narrower width of the headlap portion can allow the headlap portion to remain unexposed and not visible on the roof when installed.

The shingles include an asphalt-coated substrate. In addition to asphalt, the coating can additionally include other materials such as binders, plasticizers, fillers, modifiers, and other additives. For example, the substrate can further comprise an asphalt coating modified with a styrene-butadiene-styrene (SBS) polymer. For instance, the filler can include a water insoluble powder naturally occurring in various forms such as, for purposes of example, limestone. In one embodiment, the asphalt coating can be loaded with an SBS polymer up to approximately 40% of the asphalt coating, prior to the addition of any fillers, etc. to the coating. In other embodiments of the disclosed subject matter, the SBS polymer can comprise up to approximately 15% of the net composition of the coating inclusive of fillers and the like, and in particular can comprise approximately 5% to approximately 11% of the net composition of the coating inclusive of fillers and the like. The addition of the SBS polymer can greatly enhance the flexibility of the shingle unit and each respective hip and ridge shingle.

The shingle unit can include a first surface and a second surface. FIG. 1 depicts the first surface 210 of the shingle unit 100. The first surface 210 has the headlap portion 215 and the exposure portion 220. As known in the art, shingles are traditionally installed overlapping such that the headlap of a shingle is disposed underneath the exposed portion of another shingle thereabove. Accordingly, when the respective shingles 101A-C are installed, the headlap portion 215 is substantially unexposed to weather elements, whereas the exposure portion 220 is exposed to weather elements.

The headlap portion 215 can comprise a transition zone 230 disposed at an edge region of the substrate distal to the exposure portion 220. The transition zone 230 can reduce effects of an impact force from an external environment, such as due to hail or ice or other debris, on a second shingle overlaying the shingle in a second course of shingles, as further discussed herein.

Figures 1A, 5A:
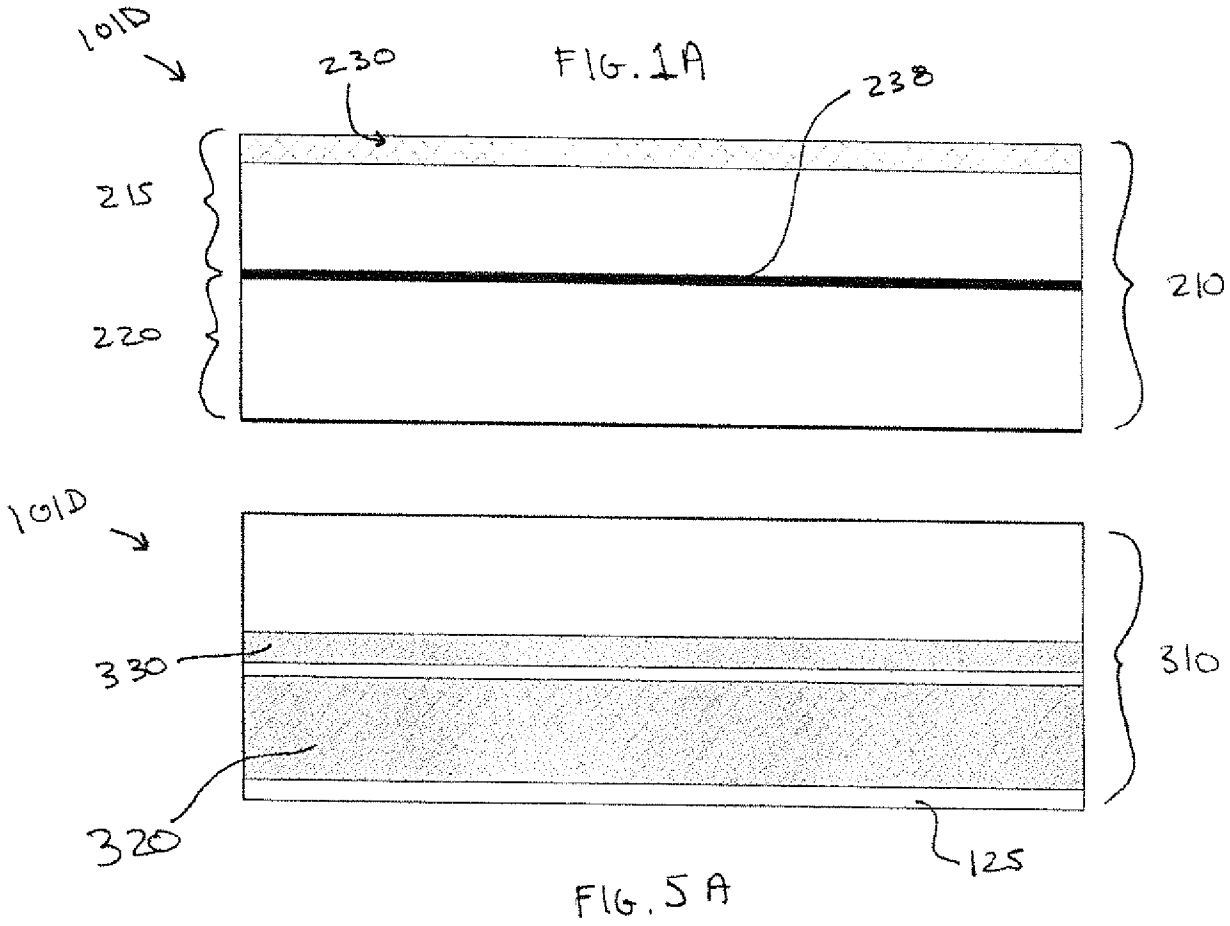
FIG. 1A depicts a first surface of a strip shingle, according to another embodiment of the disclosed subject matter.
FIG. 5A depicts a second surface of the strip shingle of FIG. 1A, according to another embodiment of the disclosed subject matter.

As noted above, the presently disclosed subject matter may be applied to shingle types other than hip and ridge, including, but not limited to, strip shingles, three-tab shingles, and laminated shingles. For illustrative purposes, FIG. 1A depicts a first surface 210 of a standard, strip shingle 101D, according to another embodiment of the disclosed subject matter. Like the hip and ridge shingles 101A-101C of FIG. 1, the strip shingle 101D includes a transition zone 230 at the headlap portion 215, as depicted. The headlap portion 215 can further include a self seal stripe 238, as discussed in more detail below.

Figure 2:
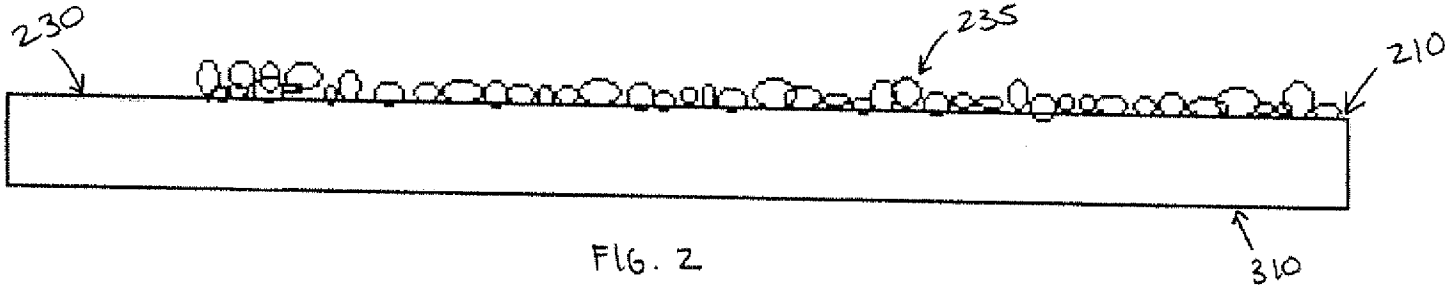
FIG. 2 depicts a magnified cross section of a shingle, according to an embodiment of the disclosed subject matter.

FIG. 2 is a cross-sectional profile view of a shingle 101, according to an embodiment of the disclosed subject matter. The cross-sectional profile view of FIG. 2 is magnified and exaggerated for purposes of discussion and is not drawn to scale. The shingle 101 of FIG. 2 includes a substrate which has a first surface 210 and a second surface 310. The first surface 210 of the substrate, exclusive of the transition zone 230, can comprises granules and/or fines 235. As depicted in FIG. 2, the transition zone 230 is substantially free of the granules 235.

Figure 3:
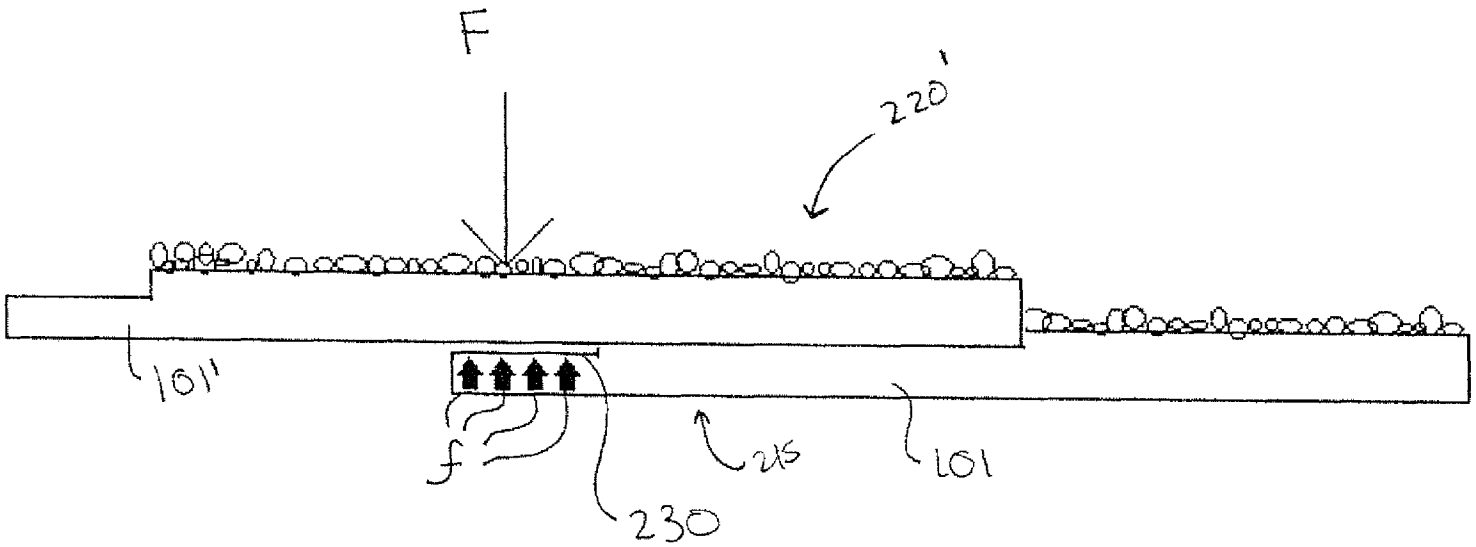
FIG. 3 depicts a roofing system, according to another embodiment of the disclosed subject matter.

FIG. 3 depicts a partial cross-sectional view of a roofing system, according to an embodiment of the disclosed subject matter. The view of FIG. 3 is magnified and exaggerated for purposes of discussion and is not drawn to scale. As shown, the roofing system includes a first shingle 101 having a headlap portion 215 disposed underneath an exposure portion 220' of a second shingle 101'. The transition zone 230 of the first shingle 101 reduces effects of an impact force F on the second shingle 101' when the impact force F from an external environment strikes the second shingle 101'. As previously discussed, the thickness at the transition zone 230 is smaller than the thickness of the remaining area of the shingle 101. The surface area of the transition zone 230 can distribute and absorb the force F across the entire surface area of the transition zone 230. Thus, the counteracting force returned to the second shingle 101' from the first shingle 101 can be distributed across the transition zone 230, as represented by the arrows f in FIG. 3. Instead of a relatively sharp point provided by the edge of a conventional underlying shingle, the transition zone 230 better supports the overlapping shingle so as not to damage the overlapping shingle. As such, the transition zone 230 of the first shingle 101 reduces effects of the impact force F from the external environment on the second shingle 101' overlaying the first shingle 101 in a second course of shingles.

Figure 3B:
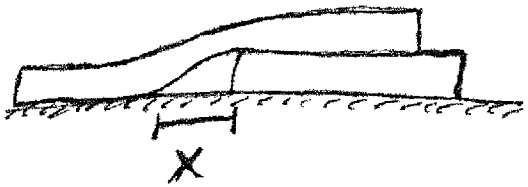
FIG. 3B (PRIOR ART)
FIG. 3B (Prior Art) depicts a conventional roofing system as known in the art.
Figure 3A:
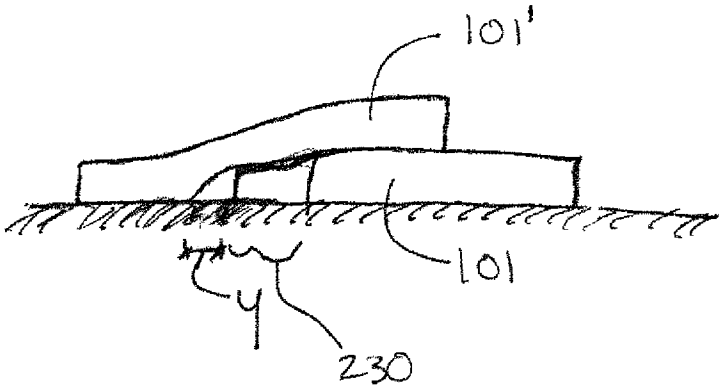
FIG. 3A depicts a roofing system, according to another embodiment of the disclosed subject matter.

Furthermore, the roofing system as shown in FIG. 3 includes rigid shingles for purposes of illustration only. A person of ordinary skill in the art understands that the shingles described herein further include flexible characteristics with the ability to bend and conform to each other in an overlapping relationship and the roof therebelow, as further shown schematically in FIG. 3A. It is appreciated that the overlapping shingles at least conform due to gravity to the shape of the object beneath them, such as the headlap portion being in contact with the roof itself. The transition zone 230 of FIG. 3A according to the disclosed subject matter reduces the portion Y of the first shingle 101' which is not backed or supported by the underlying second shingle 101. The unsupported portion Y can be vulnerable to the external forces, such as hail. For purposes of illustration, FIG. 3B shows an example of a conventional roofing system with overlapping shingles that do not include a transition zone. As depicted, the portion X of the overlapping shingle is not backed or supported by the underlying second shingle. The unsupported portion X is significantly greater than the portion Y of the roofing system of FIG. 3A, such that X>Y. The conventional roofing system of FIG. 3B is far more vulnerable to external forces than the disclosed roofing system of FIG. 3A.

Figure 4:
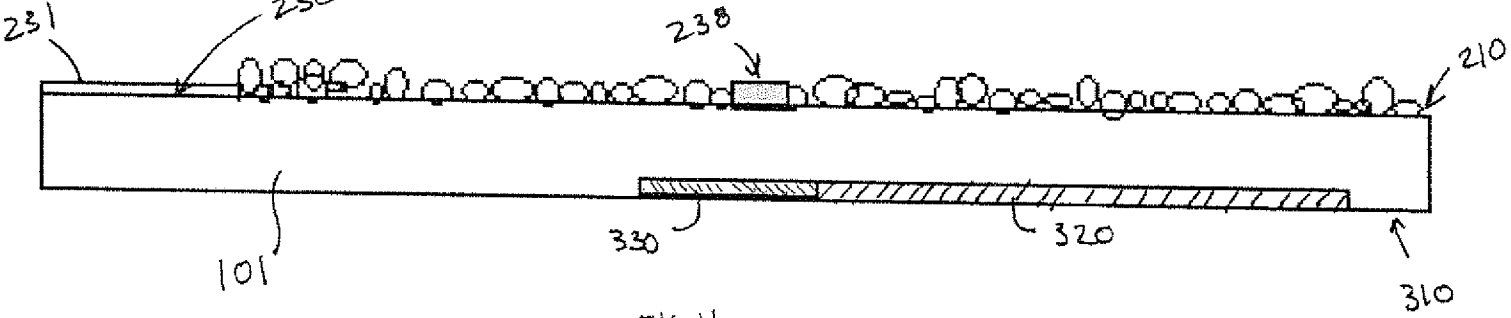
FIG. 4 depicts a magnified cross section of a shingle, according to another embodiment of the disclosed subject matter.
Figure 4A:
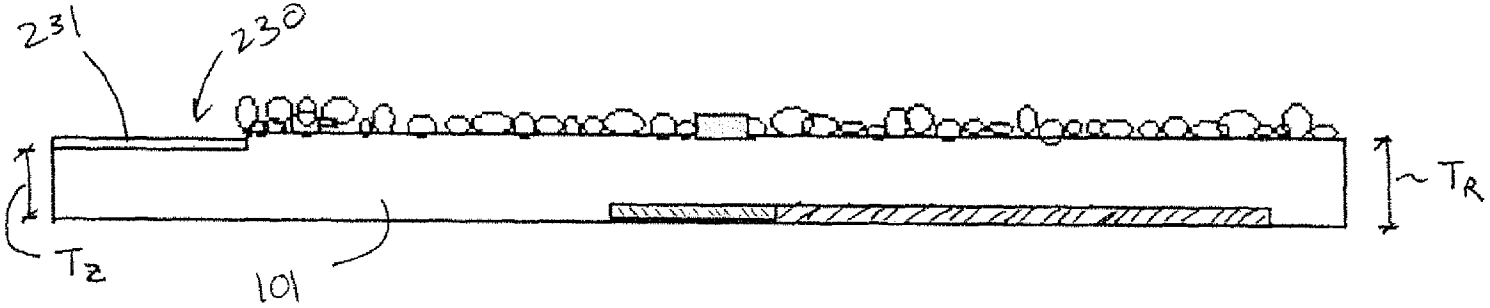
FIG. 4A depicts a magnified cross section of a shingle, according to another embodiment of the disclosed subject matter.

A transition layer can further be provided at the transition zone and coupled to the headlap portion. FIG. 1 shows a transition layer 231 located at the transition zone 230 of the shingle unit 100. The transition layer 231 can have a width extending a width $W_T$ of the transition zone. The width of the transition layer and also the transition zone can range up to approximately 4 inches, and can be 1.25 inches in particular. The transition layer 231 maintains a smaller thickness dimension at the transition zone than the thickness dimension of the remaining area of the shingle 101. The transition layer 231 can also be embedded in the shingle 101 during manufacture. FIG. 4 is a cross-sectional profile view of a shingle 101, according to an embodiment of the disclosed subject matter. The cross-sectional profile view of FIG. 4 is magnified and exaggerated for purposes of discussion and is not drawn to scale. The shingle 101 of FIG. 4 depicts the transition layer 231 coupled to the headlap portion at the transition zone 230. In some embodiments, the embedded transition layer 231 is the transition zone that creates the reduced thickness, as shown in FIG. 4A. The substrate has a smaller thickness dimension $T_Z$ at the transition zone 230 than a thickness dimension $T_R$ of a remaining area of the substrate.

The transition layer can include any suitable material and can further have absorbent characteristics. For purposes of example, the transition layer can include non-adhesive tape, clear biaxially oriented polyester release film, fabric, woven and nonwoven material, polypropylene release film, and fine mineral matter.

Figure 5:
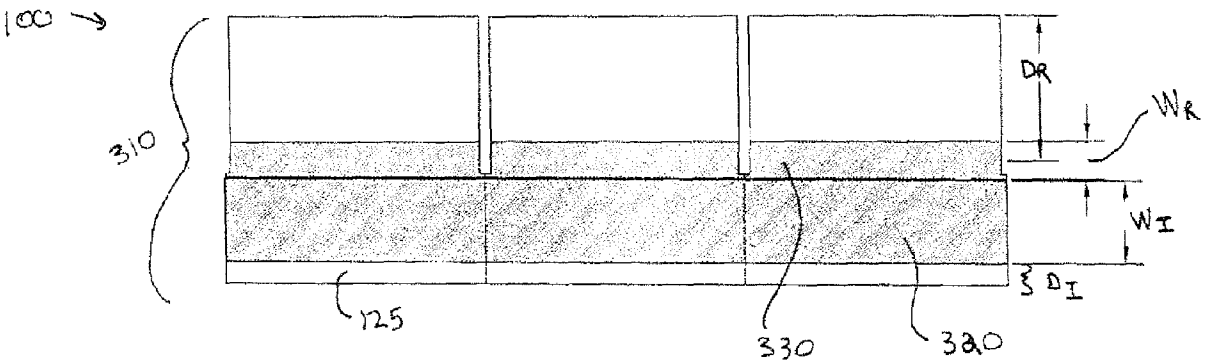
FIG. 5 depicts the unexposed side of the shingle unit of FIG. 1, according to an embodiment of the disclosed subject matter.

FIG. 5 depicts the second surface 310 of the shingle unit 100 of FIG. 1, according to an embodiment of the disclosed subject matter. The second surface 310 is unexposed to weather conditions such as hail, ice, debris, and the like. The shingle unit 100 can further include an impact layer 320 coupled to the second surface 310 opposite the exposure portion 220 of the first surface 210. The impact layer 320 can reinforce the shingles 101A, 101B, and 101C, and can absorb an impact force from the external environment on the shingle. The impact layer 320 can have any suitable width $W_1$ such as for example, between approximately 3 to approximately 5 inches, and in particular approximately 3.75 inches. As depicted in both FIG. 4 and FIG. 5, the impact layer 320 can be spaced from a bottom edge 125 of the shingle unit 100. In one embodiment, the impact layer 320 is disposed at a distance $D_I$ of approximately 1 inch from the bottom edge of the shingle unit. However, other embodiments include no space between the impact layer 320 and the bottom edge of the shingle unit.

The impact layer can include any suitable material and can further have impact absorbing characteristics. For purposes of example, the impact layer can include spunbond polyester, polyester, polyester mat, spun bond polypropylene, polyolefin, copolymer with at least one polyolefin, thermoset material, elastic material, laminates nonwoven polyethylene terephthalate ("PET") mat coated with polyethylene, rubber pellets, and ground up recyclable material such as tires. In one embodiment, the impact layer comprises a spunbond polyester tape that includes elongation and tensile characteristics that meet ASTM D5035-90 and includes a weight that meets ASTM D3776.

As depicted in FIG. 1 and also in FIG. 4, the shingle unit 100 or the shingle 101 can further include a self seal stripe 238. The stripe 238 can be positioned approximately at a longitudinal center of the shingle unit or shingle and disposed between the headlap portion 215 and the exposure portion 220. The stripe 238 can have a width $W_S$ of approximately 0.5 inches, and in particular be 0.375 inches. In an embodiment according to the disclosed subject matter, the center of the stripe 238 can be disposed at a distance $D_S$ approximately 5.5 inches from the lower edge of the shingle unit 100 opposite the transition zone, and in particular be 5.56 inches from the lower edge. When the shingles are installed as part of a roofing system, the stripe 238 can be aligned with the bottom edge 125 of an overlying shingle to adhere the overlapping shingle with the underlying shingle together. The self seal stripe 238 can include any suitable adhesive such as, but not limited to, asphalt flux, polymer (SBS, SIS, SEBS, SEPS), and filler.

As depicted in FIG. 5, the shingle unit 100 can further include a release layer 330 disposed adjacent the impact layer 320 opposite the bottom edge 125. In some embodiments, the release layer 330 can be spaced from the impact layer 320, such as, for example approximately 0.625 inches. The impact layer 320 and the release layer 330 can be embedded into the shingle during manufacture. FIG. 4 depicts the shingle unit 100 having both the impact layer 310 and release layer 330 embedded into the shingle 101. The release layer 330 can have any suitable width $W_R$, such as for example, between approximately 1 to approximately 2 inches, and in particular approximately 1.5 inches. A center of the release layer 330 can be disposed at a distance $D_R$ of approximately 6 to approximately 7 inches, and in particular 6.4375 inches from the top of the shingle unit opposite the bottom edge 125. The release layer can include any suitable material and can further have absorbent characteristics.

During shipping of the shingle units, the release layer 330 is intended to align with the seal stripe 238. The release layer 330 can include anti-adhesive properties such that stacks of shingles overlying each other during shipment will not stick together.

FIG. 5A depicts a second surface 310 of the strip shingle 101D of FIG. 1A. Like the hip and ridge shingles 101A-101C of FIG. 5, the strip shingle 101D includes an impact layer 320 coupled to the second surface 310 opposite the exposure portion 220 of the first surface 210. The strip shingle 101D can further include a release layer 330 disposed adjacent or spaced from the impact layer 320 opposite the bottom edge 125. During shipping of the strip shingles, the release layer 330 is intended to align with the seal stripe 238 of an overlapping strip shingle to prevent sticking.

The disclosed subject matter can be utilized for any kind of shingle. In particular, as described above, the shingles can be hip and ridge shingles which can experience more impacts than other kinds of shingles, as well as strip shingles, three-tab shingles, laminated shingles, or any other type of shingle. With the disclosed features of the subject matter, the shingles and shingle units of the disclosed subject matter satisfy UL 2218 of the Underwriters Laboratories Standard for an impact resistance of at least class 4.

While the disclosed subject matter is described herein in terms of certain preferred embodiments, those skilled in the art will recognize that various modifications and improvements can be made to the disclosed subject matter without departing from the scope thereof. It should be understood that the foregoing descriptions and examples are illustrative, and that compositions other than those described above can be used as the transition layer and impact layer while still utilizing the principles underlying the disclosed subject matter.

Additional features known in the art likewise can be incorporated, such as disclosed in U.S. Pat. No. 6,341,462 B2, and U.S. Pat. No. 7,851,051, which are incorporated in their entirety by reference herein. Moreover, although individual features of one embodiment of the disclosed subject matter can be discussed herein or shown in the drawings of the one embodiment and not in other embodiments, it should be apparent that individual features of one embodiment can be combined with one or more features of another embodiment or features from a plurality of embodiments.

In addition to the various embodiments depicted and claimed, the disclosed subject matter is also directed to other embodiments having any other possible combination of the features disclosed and claimed herein. As such, the particular features presented herein can be combined with each other in other manners within the scope of the disclosed subject matter such that the disclosed subject matter includes any suitable combination of the features disclosed herein. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the disclosed subject matter without departing from the spirit or scope of the disclosed subject matter. Thus, it is intended that the disclosed subject matter include modifications and variations that are within the scope of the appended claims and their equivalents.

What is claimed is:

1. An impact resistant shingle, comprising:

an asphalt-coated substrate having a first surface and a second surface, the first surface having a headlap portion and an exposure portion, wherein the headlap portion comprises a transition zone disposed at a longitudinal edge region of the substrate distal to the exposure portion, wherein the first surface of the substrate exclusive of the transition zone comprises granules, wherein the shingle has a smaller thickness dimension at the transition zone than a thickness dimension of a remaining area of the shingle.

2. The impact resistant shingle according to claim 1, wherein the transition zone reduces effects of an impact force from an external environment on a second shingle overlaying the shingle in a second course of shingles.

3. The impact resistant shingle according to claim 1, further comprising a transition layer coupled to the headlap portion at the transition zone and having a width extending a width of the transition zone, wherein the transition layer maintains a smaller overall shingle thickness dimension at the transition zone.

4. The impact resistant shingle according to claim 3, wherein the transition layer is embedded in the shingle.

5. The impact resistant shingle according to claim 3, wherein the transition layer comprises at least one of non-adhesive tape, biaxially oriented polyester release film, fabric, woven material, nonwoven material, polypropylene release film, and fine mineral matter.

6. The impact resistant shingle according to claim 1, further comprising an impact layer coupled to the second surface opposite the exposure portion, wherein the impact layer reinforces the shingle and wherein an impact force from an external environment is absorbable by the impact layer.

7. The impact resistant shingle according to claim 6, wherein the impact layer comprises at least one of polyester, polyester mat, spun bond polypropylene, polyolefin, copolymer with at least one polyolefin, thermoset material, elastic material, laminates nonwoven polyethylene terephthalate ("PET") mat coated with polyethylene, rubber pellets, and ground up recyclable material.

8. The impact resistant shingle according to claim 6, wherein the impact layer is spaced from a bottom edge of the shingle.

9. The impact resistant shingle according to claim 1, wherein the asphalt-coating of the substrate further comprises styrene-butadiene-styrene (SBS) polymer.

10. The impact resistant shingle according to claim 9, wherein the SBS polymer comprises approximately 2% to approximately 6% of the net composition of the asphalt-coating.

11. The impact resistant shingle according to claim 1, wherein the shingle comprises a hip or ridge shingle.

12. The impact resistant shingle according to claim 1, wherein the shingle comprises a strip shingle.

13. The impact resistant shingle according to claim 1, wherein the shingle comprises a three-tab shingle.

14. The impact resistant shingle according to claim 1, wherein the shingle comprises a laminated shingle.

15. The impact resistant shingle according to claim 1, wherein the shingle satisfies UL 2218 of the Underwriters Laboratories Standard for an impact resistance of at least class 4.

16. An impact resistant shingle, comprising:

a substrate comprising an asphalt coating modified with styrene-butadiene-styrene (SBS) polymer, the substrate having a first surface and a second surface, the first surface having a headlap portion and an exposure portion, wherein the headlap portion comprises a transition zone disposed at a longitudinal edge region of the substrate distal to the exposure portion, wherein the first surface of the substrate exclusive of the transition zone comprises granules, wherein the shingle has a smaller thickness dimension at the transition zone than a thickness dimension of a remaining area of the shingle;

an impact layer coupled to the second surface opposite the exposure portion, wherein the impact layer reinforces the shingle and absorbs an impact force from an external environment; and a transition layer coupled to the headlap portion at the transition zone and having a width extending a width of the transition zone, wherein the transition layer maintains a smaller thickness dimension of the shingle at the transition zone.

17. The impact resistant shingle according to claim 16, wherein when the transition zone of the shingle reduces effects of an impact force from an external environment on a second shingle overlaying the shingle in a second course of shingles.

18. A roofing system of impact resistance shingles, comprising:

a first shingle, including a substrate comprising an asphalt coating modified with styrene-butadiene-styrene (SBS) polymer, the substrate having a first surface and a second surface, the first surface having a headlap portion and an exposure portion, wherein the headlap portion comprises a transition zone disposed at a longitudinal edge region of the substrate distal to the exposure portion, wherein the first surface of the substrate exclusive of the transition zone comprises granules, wherein the shingle has a smaller thickness dimension at the transition zone than a thickness dimension of a remaining area of the shingle, an impact layer coupled to the second surface opposite the exposure portion, wherein the impact layer reinforces the shingle and absorbs an impact force from an external environment, and a transition layer coupled to the headlap portion at the transition zone and having a width extending a width of the transition zone, wherein the transition layer maintains a smaller thickness dimension of the shingle at the transition zone; and a second shingle adjacent the first shingle, the second shingle including an substrate comprising an asphalt coating modified with styrene-butadiene-styrene (SBS) polymer, the substrate having a first surface and a second surface, the first surface having a headlap portion and an exposure portion, wherein the headlap portion comprises a transition zone disposed at a longitudinal edge region of the substrate distal to the exposure portion, wherein the first surface of the substrate exclusive of the transition zone comprises granules, wherein the shingle has a smaller thickness dimension at the transition zone than a thickness dimension of a remaining area of the shingle, an impact layer coupled to the second surface opposite the exposure portion, wherein the impact layer reinforces the shingle and absorbs the impact force from the external environment, and a transition layer coupled to the headlap portion at the transition zone and having a width extending a width of the transition zone, wherein the transition layer maintains a smaller thickness dimension of the shingle at the transition zone, wherein the headlap portion of the first shingle is disposed underneath the exposure portion of the second shingle, and wherein the transition zone of the first shingle reduces effects of the impact force on the second shingle when the impact force from the external environment strikes the second shingle.

19. The roofing system according to claim 18, wherein the first shingle and the second shingle each comprises a hip or ridge shingle.

20. The roofing system according to claim 18, wherein the shingle comprises a strip shingle.

* * * * *